US005664261A

United States Patent [19]

Lacy

[11] Patent Number: 5,664,261

[45] Date of Patent: Sep. 9, 1997

[54] PROTECTIVE HEADWEAR

[76] Inventor: Robbin J. Lacy, P.O. Box 1077, Ashland, Oreg. 97520

[21] Appl. No.: 757,076

[22] Filed: Nov. 26, 1996

[51] Int. Cl.[6] ..... A42B 1/06

[52] U.S. Cl. ..... 2/172; 2/195.1; 2/209.13

[58] Field of Search ..... 2/172, 175.1, 175.6, 2/195.1, 209.13

[56] References Cited

U.S. PATENT DOCUMENTS

| | | |
|---|---|---|
| D. 112,585 | 12/1938 | Freydberg . |
| D. 114,906 | 5/1939 | Rothchild . |
| D. 271,250 | 11/1983 | Burgin et al. . |
| 1,234,828 | 7/1917 | Tramana . |
| 2,349,471 | 5/1944 | Starbeck . |
| 4,096,590 | 6/1978 | Keshock . |
| 5,048,128 | 9/1991 | Watson, Jr. . |
| 5,159,720 | 11/1992 | Scott, Jr. . |

*Primary Examiner*—Diana Biefeld
*Attorney, Agent, or Firm*—Richard C. Litman

[57] ABSTRACT

Headwear providing protection against the sun includes a crown, brim and drape all formed of a lightweight, water repellant fabric and which is readily foldable into a flat condition. With the brim extending no less than 180 degrees about the crown lower edge and conjoined to the drape, full circle shielding against sun rays is achieved. Flotation of the headwear is assured by the inclusion of a closed cell foam layer intermediate two fabric layers defining the brim. The provision of open mesh ventilation panels in the lateral portions of the crown dissipates heat buildup within the crown while alternate positioning of the drape is accomplished through the engagement of a releasable fastener element on the lower portion of the drape, with a mating fastener element on the rear of the crown. Adaptability to various head sizes is facilitated by the action of an elasticized segment at the rear of the headwear plus the alternate provision of an adjustable strap assembly.

13 Claims, 3 Drawing Sheets

PROTECTIVE HEADWEAR

BACKGROUND OF THE INVENTION

1. Field of the Invention

This invention relates generally to hats and more particularly, to improved headwear offering enhanced protection against sun exposure to both the head and neck.

2. Description of the Prior Art

An early example of the most basic headwear intended to provide protection against the sun may be considered to be no more than a scarf member wrapped about one's head and which includes a tail portion draped over the wearer's neck and alternately wrapped across the face. Such headwear is most often identified with that as worn by residents of the North Africa desert regions and will be acknowledged to shield one's head, face and neck against exposure to both the sun and blowing sand. Such headwear may be considered by some persons to be a bit extreme and counter to current fashion trends. In any case, such a device falls short of allowing for ventilation and most certainly requires decided skill in its use, by the majority of persons.

Functionality aside, most users associate headwear with a device having a brim with a headband or the equivalent, with or without a crown and such headwear finds broad appeal with persons engaged in all sorts of outdoor activities including but not limited to, those whose trade or sports activities keep them in the out of doors a good part of any sunny day.

An early example of a hat offering a wide brim will be found in U.S. Design Pat. No. 112,585 issued Dec. 13, 1938 and which depicts a brim of varying width and which appears to divulge a trim element on its inner edge presenting an open top area leaving the crown of a wearer's head exposed to the elements. This is in contrast to the instant device wherein protection is offered to one's face, entire head as well as the neck.

The hat shown in U.S. Design Pat. No. 114,906 issued to Rothchild on May 23, 1939 illustrates a full, imperforate crown bounded by a rolled, minimal width brimlike member with a gathered tail portion streaming from the rear of the crown portion. Again, the present device differs in offering a partially nonimperforate crown and likewise includes a regulatable, functional brim and contiguous member offering full 360 degree protection against the sun.

The headgear disclosed in U.S. Pat. No. 2,349,471 issued May 23, 1944 to Starbeck includes a full circle, constant width brim and a crown section having two slide fasteners allowing the folding back of crown flaps to expose mesh sections. This arrangement is unlike that proposed herein and where adaptability is achieved by an elasticized section along the crown lower edge, in combination with an alternately displaceable neck flap or drape.

A hat provided With distinct crown ventilation portions will be found in U.S. Patent Design Pat. No. 271,250 issued Nov. 8, 1983 to Burgin et al. In this instance, the design of the hat is akin to that of the well known pith helmet which comprises a rigid crown and brim. There is not seen in this patent the soft, flexible foldable nature of the present invention, nor the alternately displaceable neck flap.

U.S. Pat. No. 1,234,828 issued to Tramana on Jul. 31, 1917 teaches the concept of a hat convertible to several styles and includes a headband frame supporting a crown frame and to which a soft crown piece and/or brim element may be attached as well as an overdrape or turban member. Tramana's arrangement lacks the partial brim member containing flotation material as in the subject invention as well as the crown ventilation segments and self-adjusting crown headband feature.

A collapsible hat will be seen in U.S. Pat. No. 4,096,590 issued Jun. 27, 1978 to Keshock and wherein a fully circular snap brim includes a sinuously configured spring member attached to the brim periphery. This is a departure from the instant arrangement wherein a soft, non fully circular brim is attached to a ventilated crown having an elasticized headband segment allowing of automatic adjustability.

U.S. Pat. No. 5,048,128 issued to Watson, Jr. on Sep. 17, 1991 discloses a version of protective headwear comprising a soft kerchief attached to a brim and includes a tie securable behind the head to retain the device upon the head with a draping portion of the kerchief shielding the back of the wearer's neck. This is contrary to the current invention wherein a distinct crown member is provided with ventilation portions and includes an elasticized rear segment from which depends a neck drape that is displaceable between use and non-use positions.

A further example of headwear provided with a ventilated section is shown in U.S. Pat. No. 5,159,720 issued Nov. 3, 1992 to Scott, Jr. and wherein the forward portion of a hat brim comprises a see-through mesh material. This is unlike the present case, wherein ventilated portions are included in the crown portion to offer cooling within the interior of the crown.

None of the above inventions and patents, taken either singly or in any combination, is seen to even remotely suggest or describe the instant invention as claimed herein.

SUMMARY OF THE INVENTION

By the present invention, a unique protective headwear is provided which is of an extremely lightweight, soft construction, lending itself to folding into a flat position and long term use without discomfort and which supplies enhanced full circle or 360 degree shielding from the sun while allowing of ventilation of the crown portion. Thin, very pliable fabric forms the entire headwear. A soft, yet snap brim extends for no less than one-half the circumference of the crown while a rear drape element continues from the distal edges of the brim, across the rear portion of the crown. The rear of the juncture between the crown and drape element includes an elasticized segment providing size adaptability while mating, releasable fasteners on the lower tail of the drape and rear of the crown allow for alternate selection of the position of the drape and its functionality.

Accordingly, one of the objects of the present invention is to provide an improved protective headwear including a soft yet adjustable brim encompassing over one-half the circumference of a flexible crown having ventilating panels therein.

Another object of the present invention is to provide an improved protective headwear including a crown attached to a brim extending a majority of the periphery of the crown to provide two distal edges in turn contiguous with a drape depending from the balance of the crown periphery.

A further object of the present invention is to provide an improved protective headwear including a crown having a peripheral headband joined to a brim and adjacent rearmost drape with the headband and attached drape provided with an elasticized segment offering adjustability to wearers of differing sizes.

Still another object of the present invention is to provide an improved protective headwear constructed of water repellant fabric and including a brim extending about a substantial portion of the crown with a foam layer within the brim to provide for flotation.

Another object of the present invention is to provide an improved protective headwear including a drape trailing from a crown with its distal portion extending well below a wearer's neck and having a fastener member allowing of retaining the drape in an alternate raised position attached to the crown.

These and other objects of the present invention will become readily apparent upon further review of the following specification and appended claims.

BRIEF DESCRIPTION OF THE DRAWINGS

Similar reference characters designate corresponding parts throughout the several figures of the drawings.

DETAILED DESCRIPTION OF THE PREFERRED EMBODIMENTS

Figure 1:
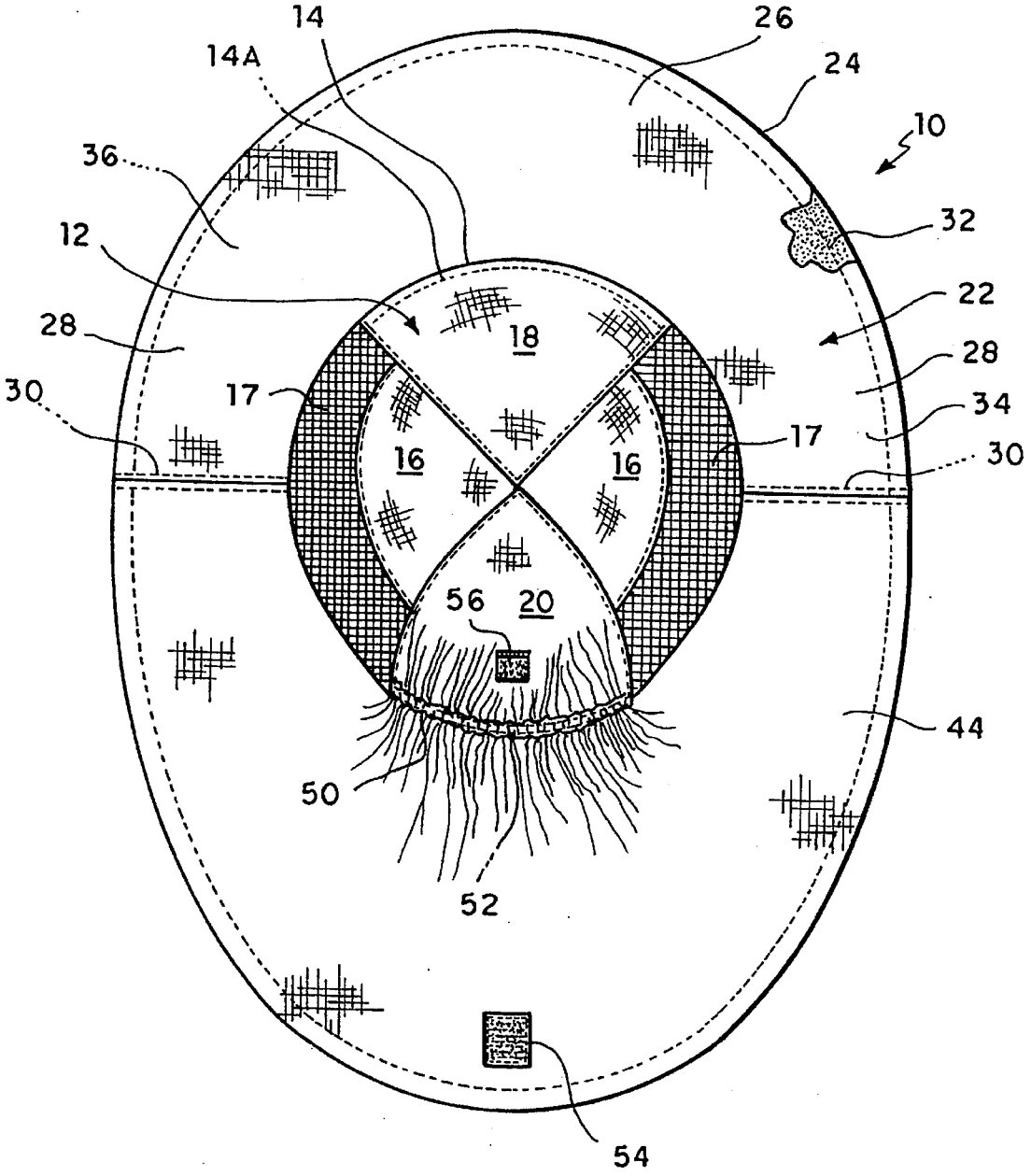
FIG. 1 is a top plan view of the headwear of the present invention with the rear most drape in its depending position.
Figure 2:
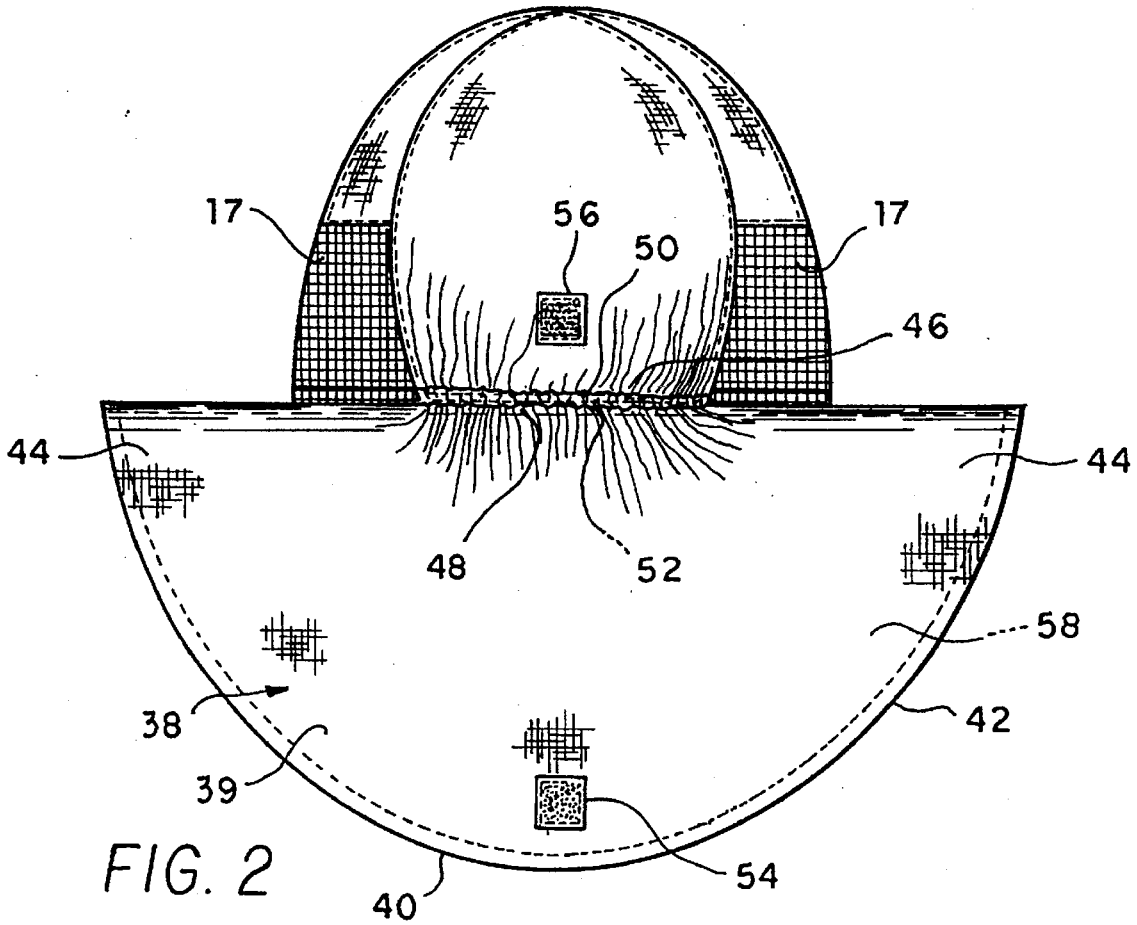
FIG. 2 is a rear elevation of the headwear of FIG. 1.

Referring now to the drawings, particularly FIG. 1, the present invention will be seen to comprise protective headwear, generally designated 10 and which includes a crown 12 having a generally circular lower periphery 14. The crown is preferably constructed of four somewhat pie-shaped sections including two lateral sections 16—16, a front section 18 and a rear section 20. These sections are cut and suitably stitched or otherwise assembled to one another to form a crown presenting an arcuate profile in side elevation as shown most clearly in FIGS. 2 and 4.

The crown front and rear sections 18,20 are preferably formed from a suitable imperforate, lightweight, water repellant fabric such as Nylon or any of several other well known synthetic fibers. Each lateral crown section 16 is likewise formed from a similar fabric but will be seen to include a lower panel of open mesh to provide a ventilation panel 17. With this construction and wherein the fabric used is white or of a light color, it will be appreciated that the crown 12 will offer the maximum reflection of the sun's rays. As the upper portion of the crown is completely imperforate, protection from direct sun rays impinging upon the critical top of a wearer's head will be provided, a worthy feature, particularly in the case of a bald headed user. At the same time, the provision of the two laterally situated ventilation panels 17,17 immediately juxtaposed the crown lower periphery 14 will allow for ingress and egress of air currents and the dissipation of any heat buildup within the crown interior.

Projecting outwardly from the crown periphery 14 is a moldable semirigid brim 22, likewise presenting a curved outer periphery 24 but, as will be seen from FIG. 1, is not congruent to the crown periphery 14. Instead, the brim is dimensioned so that its forward portion 26 is wider than that of the lateral brim portions 28—28. Unlike many hats having a bill, the brim 22 extends rearwardly from the forward portion 26 a substantial distance, to a point wherein the brim distal edges 30—30 will be located in an area disposed just above a wearer's ears. Overall, it is preferred that the brim 22 extends from the crown 12 no less than one-half its periphery 14 and may even define an arc of 270 degrees, any part of which may be adjusted to provide shielding from angled light.

The brim 22 includes a core or filler comprising a lightweight flotation element 32 such a thin layer of closed cell foam rubber or the like. This layer is sandwiched between two fabric layers, namely an upper layer 34 and lower layer 36.

A drape, kerchief or veil 38 having an outer layer 39 will be seen to depend from the crown periphery 14, in a continuous, uninterrupted manner, between the two distal edges 30—30 of the brim 22. That portion of the drape contiguous to the crown rear section 20 defines the greatest extent such that when disposed as in FIGS. 1 and 2, the lower area or tail 40 thereof will be positioned well below the wearer's neck. The outer edge 42 of the drape is likewise arcuately configured and accordingly it will be appreciated that a significant barrier against sun rays from behind will be offered, with the inherent stiffness of the brim supporting the drape lateral areas 44 in an outwardly deployed manner. With this construction, the drape will hang away from or off the neck, thus enhancing the coolness to the wearer.

To reduce the number of headgear sizes that would be required to accommodate the majority of users and also to provide a positive, yet comfortable fit for any wearer, the lower edge 46 of the crown rear section 20 together with the juxtaposed upper edge 48 of the drape, are gathered or shirred and attached to a casing 50 supplied with a length of elastic 52. With the ends of this elastic anchored at the juncture of the two lateral crown sections 16—16, the headgear will normally appear as in FIG. 1 when not being worn. In this position, the tensioning elastic 52 draws the gathered casing portion 50 together but when being worn, the user's head will be understood to at least partially expand the elastic and gathered portion so that a firm but not excessive fit of the entire crown periphery 14 will be realized.

Figure 3:
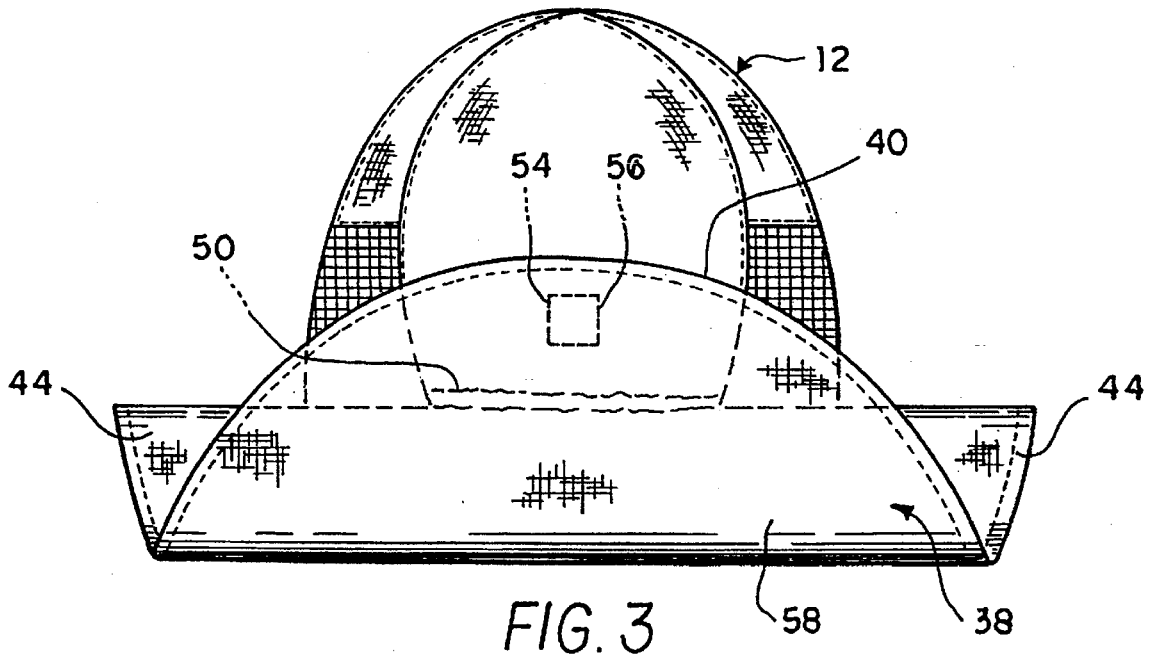
FIG. 3 is a view similar to FIG. 2 and with the drape in an alternate raised position.

During use, the headwear 10 may be worn with the drape 38 in either of alternate positions, depending upon the degree of protection from the sun that the user desires. In the natural, free-falling position as in FIG. 2, the maximum amount of shading will be offered as the drape is laterally as well as vertically spread to its majority dimension and retained thusly as the lateral areas 44—44 are projected outwardly by the firmness of the juxtaposed lateral portions 28—28 of the brim 22. Should the user not require or desire the full protection of the back of their neck as in the above described position, the drape may be readily shifted to a modified elevated position as in FIG. 3 wherein the lower tail 40 thereof is turned upwardly and retained by means of separable or releasable, mating fastener elements such as the two distinct VELCRO (hook and loop fastener) tabs 54,56 respectively mounted upon the drape tail 40 and rear crown section 20.

As previously mentioned, the brim 22 preferably comprises upper and lower layers 36 and 34 with the foam layer 32 sandwiched therebetween and this arrangement provides not only a flotation feature should the headwear 10 fall into the water but also insures the degree of stiffness to the brim 22, insuring maintenance of its outward projection from the crown lower periphery 14. With a double seam **14*a* along this lower periphery and both seams capturing the foam layer 32, it will be understood that the brim will exhibit a snap brim feature, allowing the user to modify the brim angle, as between the raised brim and lowered brim positions 22***a* and 22*b* respectively shown in FIG. 4. This double seam 14*a* may be considered to define a headband of the invention.

The drape 38 preferably comprises two layers also. In view of the thin, lightweight nature of the fabric used throughout the headwear 10, the addition of an inner layer 58 provides sufficient body to the drape to preclude it from excessive flapping in light breezes.

Either or both the brim lower layer 36 or drape inner layer 58 may comprise a color different from that of the balance of the headwear 10. For example, by utilizing white or a bright color for the crown 12 and the upper or outer fabric layers of the brim and drape, the maximum reflection of heat and sunlight will be achieved. Then, with the drape inner layer 58 and brim lower layer 36 constructed of a darker color, glare or reflected sunlight on the undersurface of the headwear may be reduced.

Figure 4:
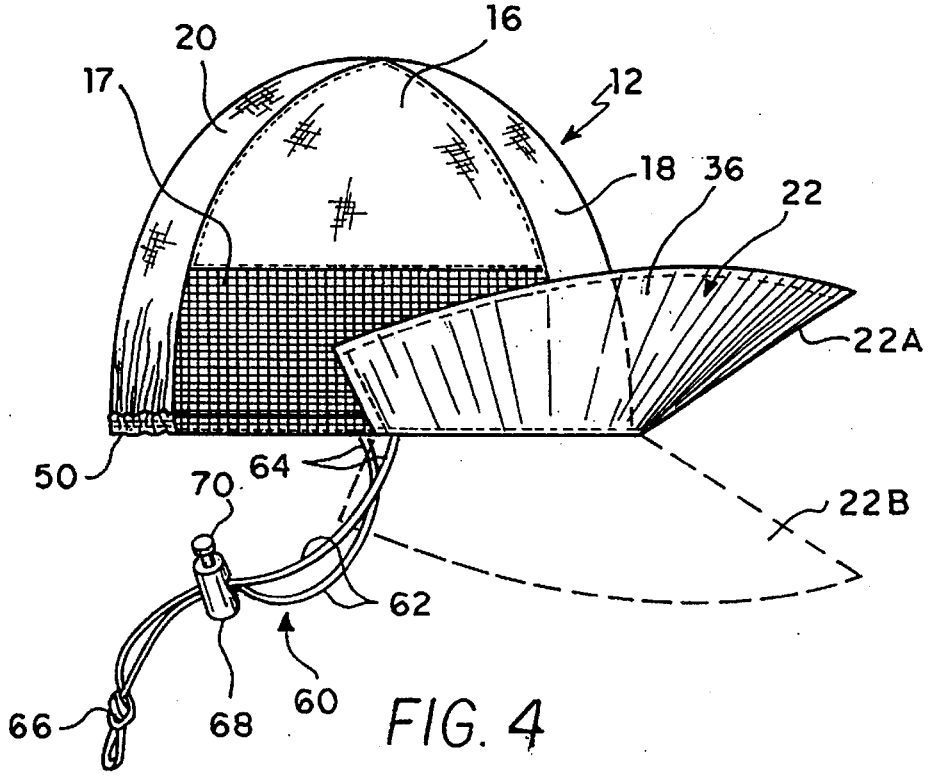
FIG. 4 is a right side elevation of FIG. 1 with the drape omitted for purposes of clarity and depicting alternate positions of the snap brim and an adjustable restraining strap.

As will be seen from FIG. 4, a string or chin strap assembly 60 depends from the crown 12 and comprises a pair of flexible cords or straps 62—62 having their respective upper ends 64—64 affixed to opposite points of the crown lower periphery 14 below the two lateral crown sections 16—16. The lower ends 66—66 of the straps 62 are tied or alternatively, may be joined as a continuous strap member (not shown). The two straps 62—62 pass through a slide or cord lock 68 adapted to provide snugging of the straps in accordance with the user's wishes. This slide 68 may comprise a simple frictional device or, include a clamping member having a finger depressible release element 70. With the foregoing in mind, it will be appreciated that the wearer will have the option of employing the strap assembly 60 as a chin strap as depicted by the broken lines in FIG. 4 or alternatively, as a head strap as shown in full lines and wherein the slide 68 will be located at the back of the head, below the rear crown section 20. This latter mode will be especially popular with women displaying their hair in a pony tail and wherein the slide will be tucked in immediately beneath the pony tail and assist in presenting the pony tail effect. Alternatively, the strap assembly 60 may be used to alter the style of the headwear when fastened up over the lateral portions of the brim 22.

Figure 5:
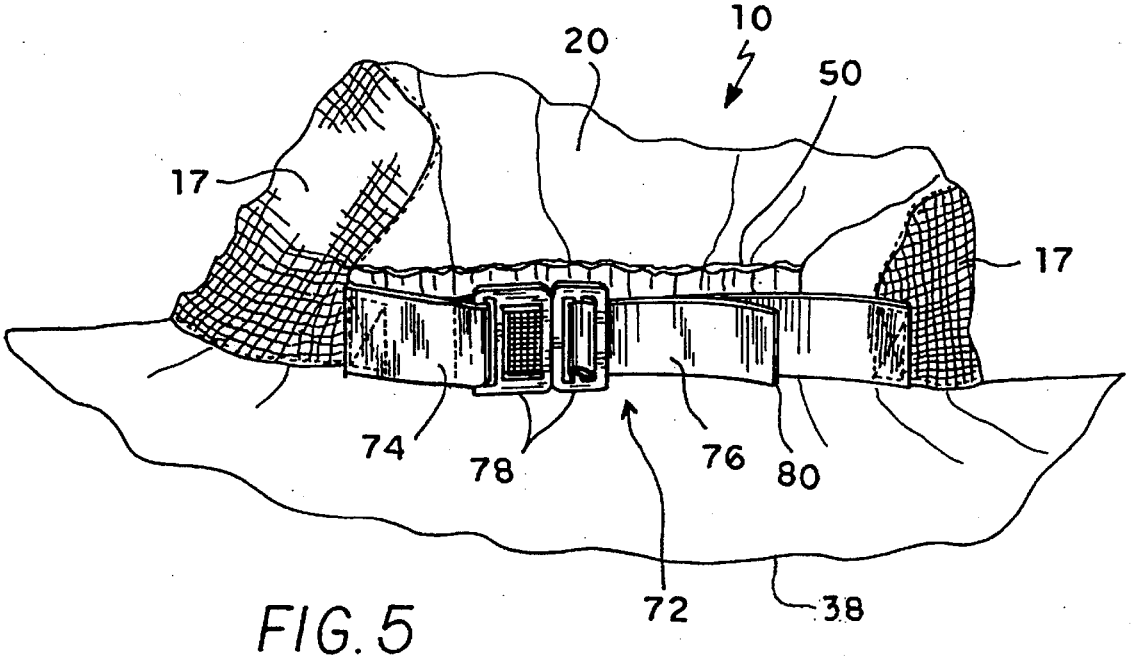
FIG. 5 is a detail elevational view showing an adjustable buckle assembly for controlling the fit of the hat on the wearer.

Controllability of the fit of the headgear 10 may be enhanced by the addition of an adjustable strap assembly 72 spanning the rear crown section 20 as shown in FIG. 5. This assembly 72 includes straps 74 and 76, respectively, anchored at the lateral. edges of the rear crown section 20 and joined by a releasable buckle 78, with one of the strap ends 80 providing adjustability at the buckle. In this manner, the user may preadjust the strap assembly 72 to define the maximum expansion of the underlying elasticized gathered area 50 so that a constant, fixed fit will be present.

It will be understood that the present invention is not limited to the embodiments described hereinabove, but encompasses any and all embodiments within the scope of the appended claims.

I claim:

1. Protective headwear comprising;

a crown having a lower periphery;

a brim affixed to said crown lower periphery and including a forward portion extending rearwardly to a pair of lateral portions each terminating in a distal edge, said brim extending from no less than one-half the circumference of said crown lower periphery;

a drape affixed to said brim lateral portion distal edges and having an upper edge attached to said crown periphery between said two brim distal edges, said drape provided with a lower area normally hanging below the back of a user's neck;

a releasable fastener element on said drape lower area; and a mating releasable fastener element on said crown adjacent said drape upper edge; whereby said brim and drape provide full circle shielding against sun effects while said drape may be selectively raised off a user's neck by engagement of said fastener element with said mating fastener element.

2. A protective headwear according to claim 1, including a ventilation panel on said crown.

3. A protective headwear according to claim 1, wherein said crown includes front, rear and two intermediate lateral sections.

4. A protective headwear according to claim 3 including a ventilation panel on each said crown lateral section.

5. A protective headwear according to claim 3, including an elastic strap on said crown rear section adjacent said drape upper edge.

6. A protective headwear according to claim 3 including an adjustable strap assembly spanning said crown rear section adjacent said drape upper edge.

7. A protective headwear according to claim 1, wherein said crown, drape and brim are fabricated of lightweight water repellant fabric, whereby said headwear is foldable into a flat condition.

8. A protective headwear according to claim 1, wherein said brim includes upper and lower fabric layers having an intermediate layer of closed cell foam, whereby said headwear is floatable upon water.

9. A protective headwear according to claim 1, including an outer periphery on said brim and an outer edge on said drape, and said brim outer periphery and drape outer edge define a continuous uninterrupted line.

10. A protective headwear according to claim 1, wherein said releasable fastener element and mating releasable fastener element comprise hook and loop fastener means.

11. A protective headwear according to claim 1, including a chin strap assembly depending from said crown lower periphery.

12. A protective headwear according to claim 11, wherein said chin strap assembly includes a pair of flexible cords, and an adjustable slide carried by said flexible cords.

13. A protective headwear according to claim 1, wherein said brim includes upper and lower fabric layers, said drape having outer and inner fabric layers, said upper and outer fabric layers comprising a light reflective color, and said lower and inner fabric layers comprising a light absorbing color.

* * * * *